United States Patent [19]

Cohen et al.

[11] 4,183,547

[45] Jan. 15, 1980

[54] WHEELIE SKATEBOARD

[75] Inventors: Arthur Cohen; Daniel R. Cohen, both of Port Washington, N.Y.

[73] Assignee: Gustave Miller, Miami, Fla., a part interest

[21] Appl. No.: 933,149

[22] Filed: Aug. 14, 1978

[51] Int. Cl.[2] ..... A63C 17/04

[52] U.S. Cl. ..... 280/87.04 A

[58] Field of Search ..... 280/87.04 R, 87.04 A, 280/11.1 R, 11.1 BT, 11.27, 11.28

[56] References Cited

U.S. PATENT DOCUMENTS

| | | | |
|---|---|---|---|
| 3,565,454 | 2/1971 | Stevenson | 280/87.04 A |
| 3,990,713 | 11/1976 | Hokanson | 280/87.04 A |
| 4,040,639 | 8/1977 | Scardenzan | 280/87.04 A |
| 4,095,817 | 6/1978 | Cohen | 280/87.04 A |

*Primary Examiner*—Richard A. Bertsch
*Assistant Examiner*—Michael Mar
*Attorney, Agent, or Firm*—Gustave Miller

[57] ABSTRACT

This device is an improved wheelie skateboard having a substantially flat horizontal portion and an integrally connected inclined rear kicktail portion. The front end of the horizontal portion has a pair of conventional skateboard wheels on a truck having a pivot bolt connected to the axle at the rear of the axle, and capable of swivelling in a conventional manner. The inclined kicktail portion has a pair of conventional skateboard wheels having a pivot bolt forward of the axle and, likewise, capable of swivelling in a normal manner. The central pair of wheels is so mounted as to be incapable of swivelling, either because of the nut on the pivot bolt (of a conventional truck), which is to the rear of the axle, is so tightened, or because a horizontal arm portion on a non-conventional truck extends from the truck rearwardly of the axle to forwardly thereof, so that such pair of wheels may tilt but may not swivel.

3 Claims, 4 Drawing Figures

WHEELIE SKATEBOARD

OBJECTS OF THE INVENTION

It is an object of this invention to provide an improved skateboard which facilitates practicing a wheelie maneuver and, at the same time, substantially lessens the danger of a spill while the operator is doing a wheelie maneuver, while at the same time being capable of steering to the right and to the left.

A further object of this invention is to provide a wheelie skateboard with an inclined upwardly extending kicktail portion and a pair of conventional wheels depending from the kicktail portion.

Yet a further object of this invention is to provide a front pair of conventional wheels and a rear kicktail pair of conventional wheels, both of which are conventionally capable of swivelling, and also to provide a special pair of wheels between the front pair and the kicktail pair, which intermediate pair is incapable of swivelling but is capable of tilting.

A still further object of this invention is to provide a wheelie skateboard on which the operator may ride on a horizontal skateboard portion, or may shift his weight to a kicktail portion and ride on the kicktail portion (for wheelie maneuvers).

A still further object of this invention is to provide a wheelie skateboard that is an improvement over that invention shown in U.S. Pat. No. 4,095,817 of Daniel R. Cohen, a co-inventor herewith, as well as all the prior art, including that cited in such Patent.

BRIEF SUMMARY OF THE INVENTION

Briefly stated, this invention consists of a wheelie skateboard having a horizontal portion and a connected inclined rear kicktail portion, the front section of the horizontal portion and the inclined kicktail section having conventional trucks and wheels, the front pair of wheels having its pivot bolt behind the axle and the kicktail pair of wheels having its pivot bolt forward of the axle, and both can swivel in a normal manner. The intermediate pair of wheels, on the rear section of the horizontal portion, is incapable of normal swivelling, either because the pivot bolt nut of a conventional truck is made so tight, or because a horizontal cylindrical arm extends forwardly from a non-conventional truck and is horizontally journaled so that, while it cannot swivel, it can tilt on this horizontal arm.

BRIEF DESCRIPTION OF THE DRAWING

With the above and other objects in view, this invention consists in the details of construction and combinations of parts as will be more fully understood from the following description, when read in conjunction with the accompanying drawing, in which.

DETAILED DESCRIPTION OF THE INVENTION

Figure 3:
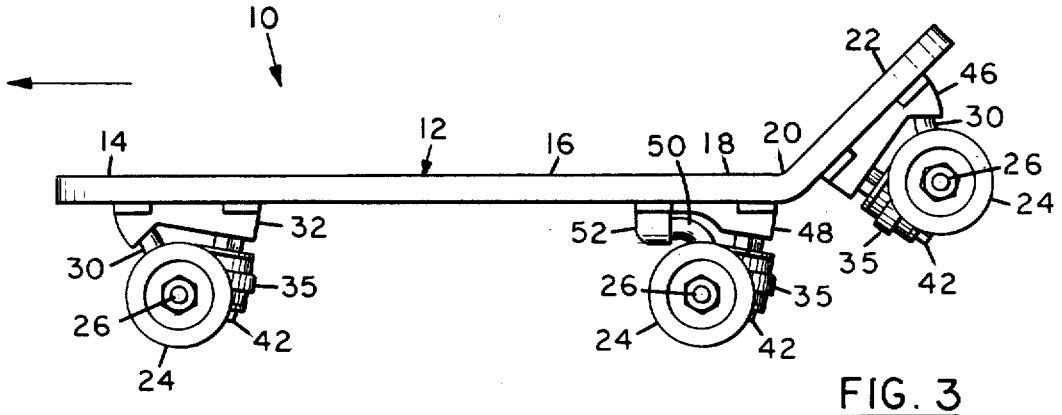
FIG. 3 is a side elevational view of a skateboard with its intermediate non-conventional truck having a horizontal journal making it capable of tilting, but incapable of normally swivelling.

There is shown at 10 the wheelie skateboard of this invention constructed with a flat elongated normal single plane horizontal platform 12 having a forward end section 14, a longitudinal center line section 16 and a rear end section 18. Extending upwardly from the rear end 20 of rear section 18 is an inclined kicktail portion 22.

Figure 2:
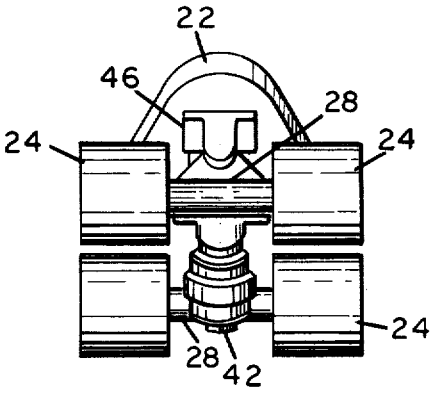
FIG. 2 is a back end view of FIG. 1.
Figure 4:
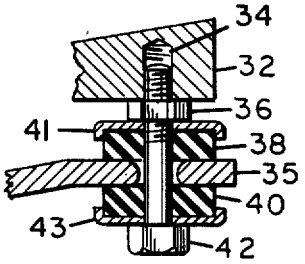
FIG. 4 is a section of the truck details.

A pair of conventional skateboard wheels 24 are journaled on a common axle 26. The axle 26 extends through a T-frame 28 (FIG. 2) having an arm 30 yieldably mounted in a truck foundation 32 secured by bolts or screws (not shown) conventionally to the bottom of the skateboard 10. A shoulder 35 extending from the T-frame 28 is apertured to receive the pivot bolt 42 therethrough.

Compressible yieldable washers 38 and 40 are on each side of shoulder 35, washer 40 is between the shoulder 35 and the metal washer 43 on the lower side, and washer 38 is between the shoulder 35 and the metal washer 41 on the upper side. This permits the truck shoulder and truck to pivot or swivel more or less, depending on how far the bolt 42 is tightened into threaded aperture 34 in the truck and held by lock nut 36. Except for the difference in orientation, the forward end wheel assembly and the kicktail wheel assembly are identical.

Figure 1:
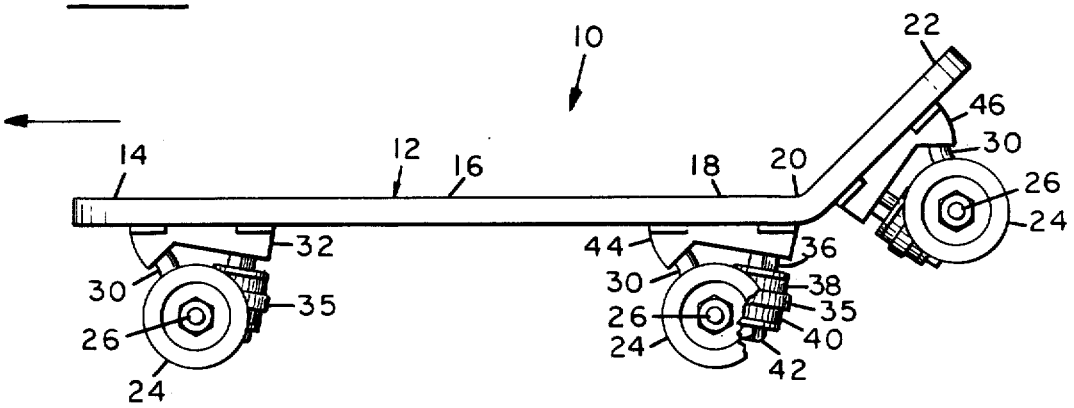
FIG. 1 is a side elevation of a wheelie skateboard of this invention, using conventional wheel trucks, broken away to show the details of the intermediate conventional truck.

In FIG. 1, however, the intermediate truck 44, which is under the rear end section 18 of the center line section 16, has its pivot bolt 42 also rearward of the axle (opposite of the mounting in a conventional skateboard not having a kicktail section with wheels). Also, this intermediate truck 44 has its pivot bolt nut so tightened that the intermediate pair of wheels are substantially incapable of swivelling, even though it is structurally identical with the other two trucks of FIG. 1. The intermediate wheels are still capable of tilting because of washers 38 and 40.

In operation of the skateboard of FIG. 1, when the skateboarder has his weight entirely on horizontal platform 12, he operates the skateboard in a substantially conventional manner and can steer by leaning toward one side or the other, for the wheels of the front truck will swivel for steering purposes, even though the truck under the rear end section cannot swivel.

To perform a wheelie operation, the skateboarder shifts his weight so as to be partially on the kicktail portion 22 and is supported on truck 44 and also on kicktail truck 46, on which the wheels can swivel as freely as on the forward end truck, thus enabling him to steer when in the wheelie position.

In the form of this invention shown in FIG. 3, the front end wheel assembly and kicktail wheel assembly are identical with that in FIG. 1. The intermediate truck 48, under the rear end section of the horizontal platform, is of somewhat different construction. This intermediate truck 48 has its arm bent over and formed into a horizontal shaft 50 which is journaled in a socket 52 integral with the truck foundation 48, which prevents swivelling.

Thus, the skateboarder may readily steer in both forms of this invention, whether supported solely on the platform horizontal section or partly on the kicktail section.

ABSTRACT OF THE DRAWING

In the drawing, like numbers refer to like parts, and for the purpose of explication, set forth below are the numbered parts of the improved WHEELIE SKATEBOARD of this invention.

10 wheelie skateboard
12 flat elongated single plane platform
14 forward end section
16 longitudinal center line section
18 rear end section
20 rear end of 18
22 upwardly extending inclined kicktail section
24 forward wheels
26 common axle for 24
28 T-frame of truck
30 truck arm
32 forward truck
34 threaded aperture in truck
35 shoulder
36 pivot bolt lock nut
38 compressible rubber washer on bolt 42
40 compressible rubber washer on bolt 42
41 upper metal washer
42 pivot bolt
43 lower metal washer
44 intermediate truck, FIG. 1
46 kicktail truck
48 intermediate truck, FIG. 3
50 shaft arm of truck 48
52 socket in which shaft arm is journaled Although this invention has been described in detail, such description is intended as being illustrative rather than limiting, since the invention may be variously embodied.

Having thus set forth and disclosed the nature of this invention, what is claimed is:

1. A wheelie skateboard (10) comprising an elongated platform for supporting a person, the platform having a forward end section (14), a longitudinal center line section (16) and a rear end section (18) in approximately the same plane with said forward and center line sections, and an inclined kicktail section (22) extending integrally upwardly and rearwardly from said platform end section (18) and merging (20) smoothly therewith, a first pair of wheels (24) and a common axle (26) coupled to and positioned on a forward truck (32) secured beneath said platform forward end section (14), a second pair of wheels and a common axle therefor coupled to and positioned on an intermediate truck (44 or 48) secured beneath said platform (12) rearward end section (18), and a third pair of wheels and a common axle therefor coupled to and positioned beneath a kicktail truck 46 secured to said kicktail section (22), all said axles being mounted on said trucks, said axle for said first pair of wheels having a truck pivot bolt (42) rearward of its said axle, said axle for said third pair of wheels on said kicktail section having a truck pivot bolt forward of its said axle, and said second pair of wheels having its axle mounted forward of its pivot bolt, and means substantially preventing said axle of said second pair of wheels from swivelling about its pivot bolt, whereby a person positioned on said platform forward of said kicktail section may ride supported on said first and second pair of wheels, or, positioned partly on said kicktail section, may ride on said skateboard supported on said second and third pairs of wheels.

2. The skateboard of claim 1, swivelling of said second truck 44 being substantially prevented by its pivot bolt being tightened substantially, and a lock nut (36) on said second truck pivot bolt holding it in tightened position.

3. The skateboard of claim 1, said second truck (48) having a horizontal shaft arm (50) connecting said second axle to said truck for tilting action about said horizontal arm.

* * * * *